US005501378A

United States Patent [19]

Kolton et al.

[11] Patent Number: 5,501,378

[45] Date of Patent: Mar. 26, 1996

[54] GARMENT HANGER

[75] Inventors: Chester Kolton, Westfield; Stuart S. Spater, Livingston, both of N.J.

[73] Assignee: B&G Plastics, Inc., Newark, N.J.

[21] Appl. No.: 279,280

[22] Filed: Jul. 22, 1994

[51] Int. Cl.[6] ..... A47G 25/28

[52] U.S. Cl. ..... 223/87; 223/85; 223/DIG. 1

[58] Field of Search ..... 223/DIG. 1, 94, 223/89, 85, 87, 88; D6/315

[56] References Cited

U.S. PATENT DOCUMENTS

| | | | |
|---|---|---|---|
| 3,243,087 | 3/1966 | Pulitzer | 223/DIG. 1 |
| 3,755,859 | 9/1973 | Solari | 223/DIG. 1 |
| 3,790,045 | 2/1974 | Rigel et al. | 223/DIG. 1 |
| 3,945,500 | 3/1976 | Meckstroth | 223/DIG. 1 |
| 5,328,065 | 7/1994 | Kolton et al. | 223/DIG. 1 |

FOREIGN PATENT DOCUMENTS

| | | | |
|---|---|---|---|
| 310204 | 10/1955 | Switzerland | 223/DIG. 1 |

*Primary Examiner*—C. D. Crowder
*Assistant Examiner*—Bibhu Mohanty
*Attorney, Agent, or Firm*—Robin, Blecker, Daley & Driscoll

[57] ABSTRACT

A garment hanger is comprised of a one-piece body having a hook portion for the receipt of a display rod, a central portion depending from the hook portion, the body defining in the central portion an opening therethrough and a garment support member disposed in the opening and movable relative to the body and a lower portion defining a fold line segment depending from the central portion and a flap segment depending from the fold line segment, the central portion, the fold line segment and the flap segment jointly defining a slot in the body which opens into a margin of the body.

11 Claims, 3 Drawing Sheets

GARMENT HANGER

FIELD OF THE INVENTION

This invention relates generally to hangers for garments and pertains more particularly to hangers for enhanced retention of garments, such as ties.

BACKGROUND OF THE INVENTION

FIGS. 1–3 depict a presently known commercial tie hanger 10, comprised of an integral plastic body having a first flap portion 12, having a generally trapezoidal cutout 14. Hanger 10 has a fold segment portion defined by fold line parts 16 and 18, each contiguous with flap portion 12 and of lesser depth than the depth of hanger 10 generally, as is seen particularly for fold line part 18 in FIG. 2.

A second flap portion 20 is contiguous with fold line parts 16 and 18 and includes a hanger part 22 having slot 22A for receipt of a display rod and tie receiving openings 24, 26 and 28 and latching openings 30 and 32.

On its rearward side, hanger 10 includes latching projections 34, each inclusive of shank 36, having a diameter somewhat less than that of openings 30 and 32, and having detents 38L(left side) and 38R(right side), respectively for forced passage through openings 30 and 32 and sized to be larger in diameter than the diameters of openings 30 and 32.

In use of hanger 10, a tie is passed through opening 24 and the rearward course of the tie is then passed through opening 26 to meet with the forward course of the tie. Then, both courses of the tie are jointly passed through opening to be dressed rearwardly jointly of hanger 10 and to extend therebelow. At that juncture, first flap portion 12 is folded about fold line parts 16 and 18 and detents 38L and 38R are forced into openings 30 and 32 to provide for capture of the two tie courses between flaps 12 and 20. A quite extensive amount of plastic material is involved in hanger 10, i.e., the folded flaps 12 and 20 are generally coextensive.

By way of further introduction to the subject invention, reference is made to copending, commonly-assigned application Ser. No. 179,909, filed on Jan. 11, 1994. That application discloses a garment hanger comprised of a one-piece body having a hook portion for the receipt of a display rod, a central portion depending from the hook portion and having first and second openings therein, and a lower portion defining a fold line segment depending from the central portion with a third opening disposed in the fold line segment and a flap segment depending from the fold line segment. The central portion and the flap segment define coactive structure for retaining the flap segment against the central portion on folding of the flap segment about the fold line segment. The coactive structure is preferably comprised of first and second projections on the flap segment adjacent respective lateral margins thereof and first and second latching openings in the central portion adjacent respective lateral margins thereof.

In use of the hanger, with the flap segment unfolded, a garment, such as a tie, is looped through the first and second openings and then passed through the third opening. The flap is now folded against the garment and latched to the central portion.

Advantage attends the hanger as against the hanger of FIGS. 1–3, e.g., in that it requires substantially less plastic material.

SUMMARY OF THE INVENTION

The present invention has as its primary object the provision of a further version of the garment hangers of the type last above discussed, particularly for tie-hanging.

In attaining the above and other objects, the present invention provides a garment hanger comprised of a one-piece body having a hook portion for the receipt of a display rod, a central portion depending from the hook portion, the body defining in the central portion an opening therethrough and a garment support member disposed in the opening and movable relative to the body and a lower portion defining a fold line segment depending from the central portion and a flap segment depending from the fold line segment, the central portion, the fold line segment and the flap segment jointly defining a slot in the body which opens into a margin of the body.

The central portion and the flap segment define coactive means for retaining the flap segment against the central portion on folding of the flap segment about the fold line segment.

The fold line segment is disposed contiguously with an interior end of the slot and provides cantilever support for the flap segment.

Assembly of the hanger with a garment is greatly facilitated by the configuration of the support member as a single member supported for movement outwardly of the plane of the hanger body for ready receipt of a loop of the garment and by the slot configuration, i.e., an extent of the garment depending from the loop is insertable sideways into the slot.

The foregoing and other objects and features of the invention will be further evident from the following detailed description of a preferred embodiment thereof and from the drawings in which like components are identified by like reference numerals throughout.

DETAILED DESCRIPTION OF THE PREFERRED EMBODIMENTS

Figure 1:
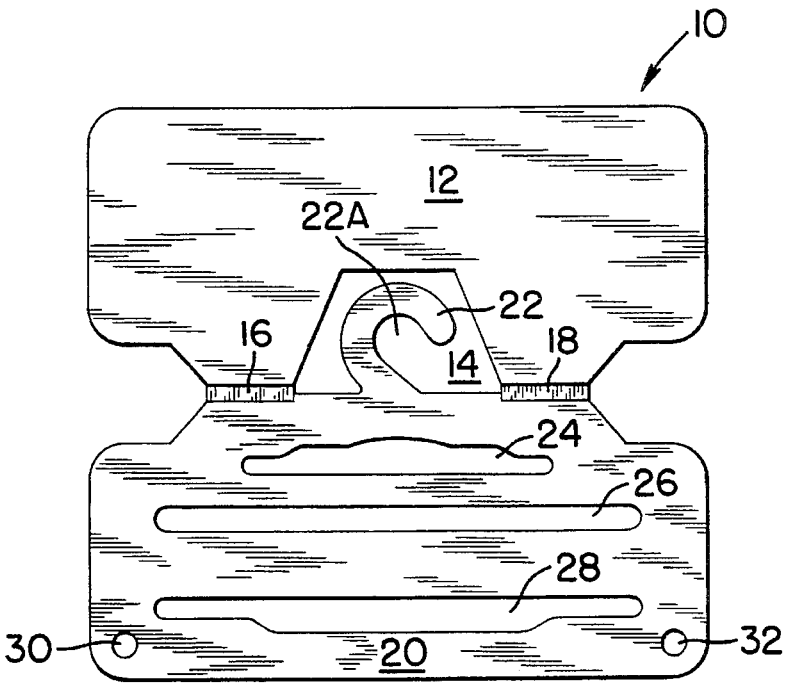
FIG. 1 (PRIOR ART)
FIG. 1 is a front elevational view of a prior art hanger.
Figure 2:
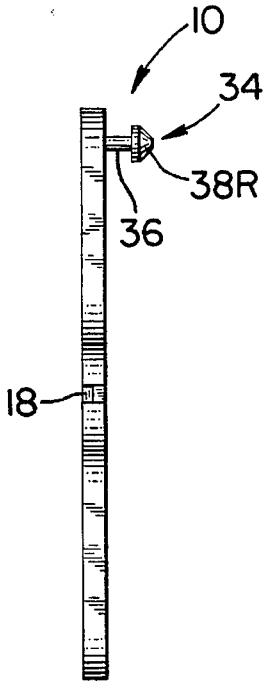
FIG. 2 (PRIOR ART)
FIG. 2 is a right side elevational view of the FIG. 1 hanger.
Figure 3:
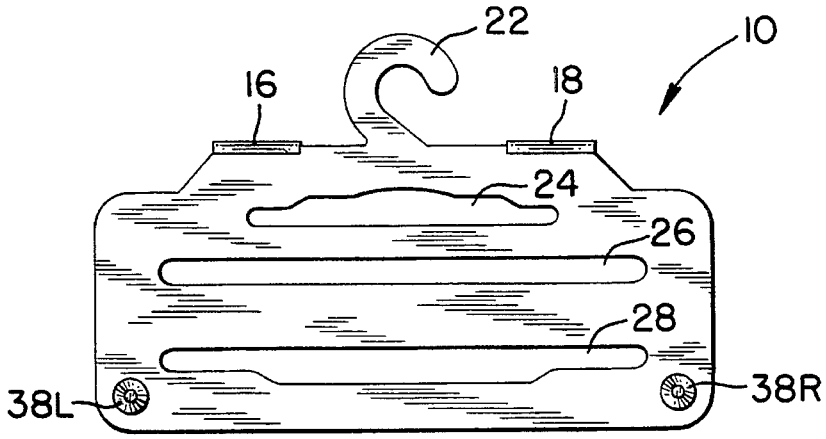
FIG. 3 (PRIOR ART)
FIG. 3 is a front elevational view of the FIG. 1 hanger upon folding thereof.
Figure 6:
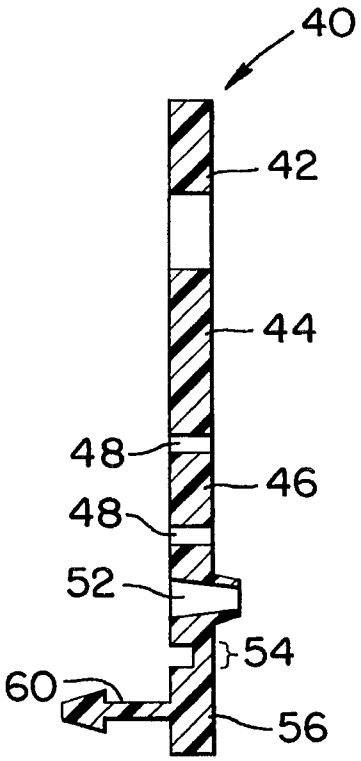
FIG. 6 is a sectional view of the FIG. 4 hanger as would be seen from broken plane VI—VI of FIG. 4.
Figure 4:
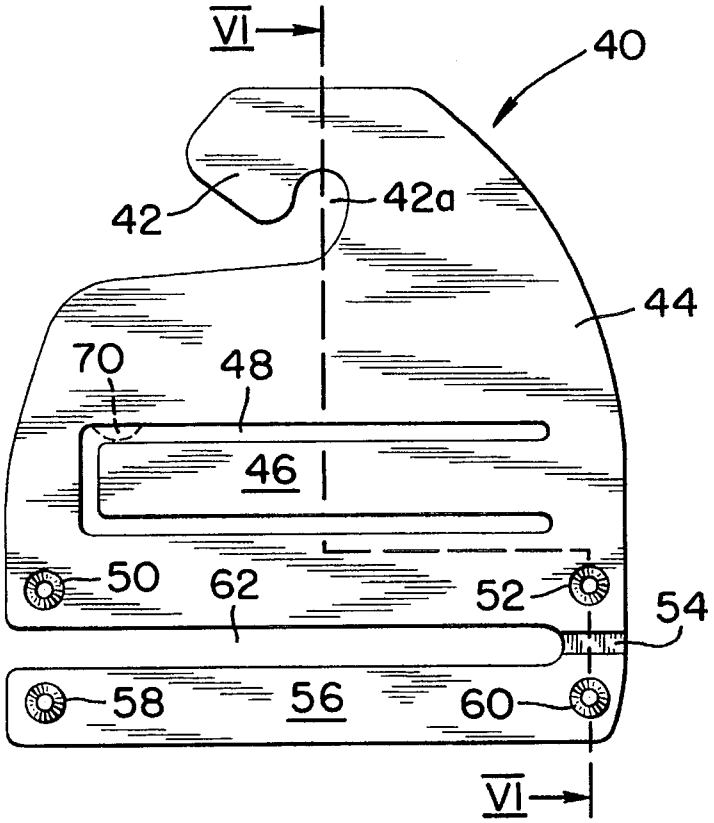
FIG. 4 is a front elevational view of a hanger in accordance with the subject invention.
Figure 5:
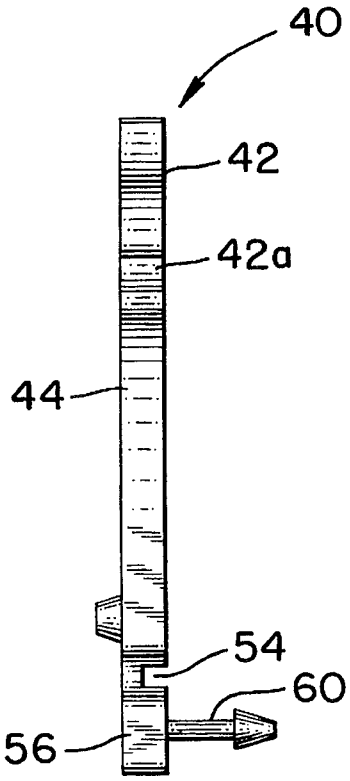
FIG. 5 is a left side elevational view of the FIG. 4 hanger.

Referring to FIGS. 4–6, garment hanger 40 is comprised of a one-piece synthetic plastic body having a hook portion 42 with an opening 42A for the receipt of a display rod. A central portion 44 of hanger 40 depends from hook portion 42 and has a garment support member 46 disposed in opening 48 and cantilever-supported by the central portion. The central portion also includes latching openings 50 and 52 adjacent respective lateral margins thereof.

A lower portion of hanger 40 has a fold line segment 54, depending from the central portion, constituted by thinning out the one-piece body to have a lesser thickness in fold line segment 54, and a flap segment, depending from the fold line segment and including a panel 56 with latching projections 58 and 60.

The latching openings and projections constitute coactive structure for retaining the flap segment against the central portion on folding of the flap segment about the fold line segment. While the hanger may be constructed such that the retention is releasable, it is preferred that the retention not be releasable and that cutting is required to remove a hung garment from the hanger. Incorporating reference is made in this respect to commonly-owned U.S. Pat. No. 5,005,741, which describes in detail the non-releasable projections and latching recess structure shown in FIGS. 4–6.

The hanger central portion, the fold line segment and the flap segment jointly define slot 62, which has an interior end with which the fold line segment is contiguous and opens into the left side margin of hanger 40. The fold line segment provides cantilever support for the flap segment.

Figure 7:
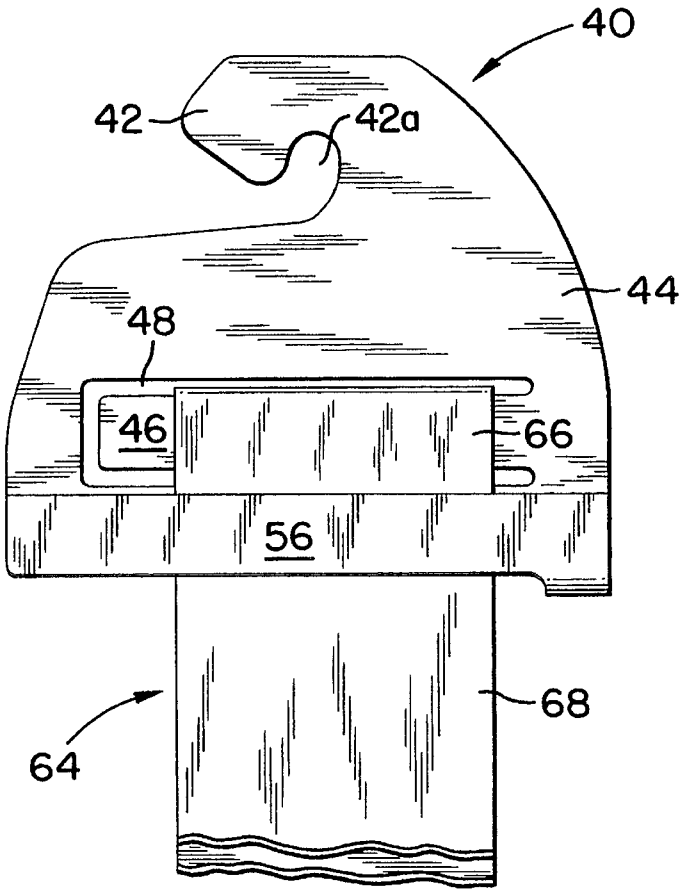
FIG. 7 is a front elevational view of the FIG. 4 hanger assembled with a tie.
Figure 8:
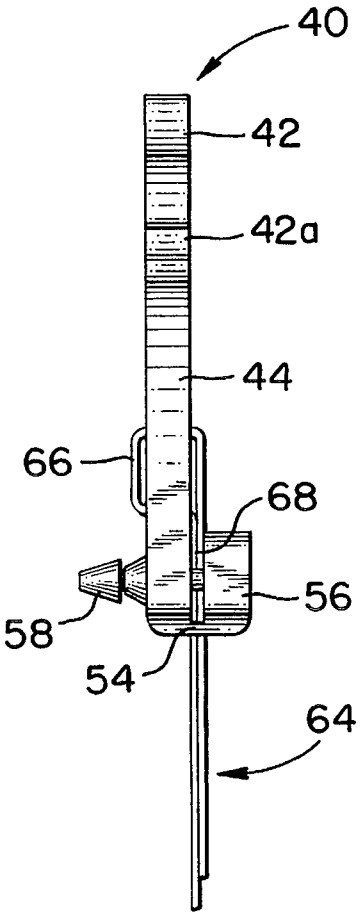
FIG. 8 is a left side elevational view of the FIG. 7 assembly.

Referring to FIGS. 7 and 8, hanger 40 is shown in assembly with tie 64, the tie having a first part 66 looped about support member 46 and a second part 68 extending through slot 66 and disposed between the central portion and the flap segment.

In reaching the assembly of FIGS. 7 and 8, an assembler forms a tie with looped first part 66 and displaces both support member 46 and panel 52 outwardly of the plane of the hanger body, e.g., rearwardly of the plane of FIG. 4. The looped first part 66 is then dressed over and about support member 46 and the second part 68 is then inserted into slot 62. Panel 52 is then folded about the fold line segment and projections 58 and 60 are forced into openings 50 and 52.

Various changes to the particularly disclosed embodiments and practices may evidently be introduced without departing from the invention. By way of example, for smaller size hangers, the central portion may include a projection extending into its opening, shown in phantom at 70 in FIG. 4. The illustrated latching structure is used for applications in which high security is desired and may be replaced with other latching structure in other applications. Accordingly, it is to be appreciated that the particularly discussed and depicted preferred embodiments and practices of the invention are intended in an illustrative and not in a limiting sense. The true spirit and scope of the invention are set forth in the ensuing claims.

What is claimed is:

1. A garment hanger comprised of a one-piece body having a hook portion for the receipt of a display rod, a central portion depending from said hook portion, said body defining in said central portion an opening therethrough and a garment support member disposed in said opening and movable relative to said body and a lower portion defining a fold line segment depending from said central portion and a flap segment depending from said fold line segment, said central portion, said fold line segment and said flap segment jointly defining a slot in said body which extends through said fold line segment and opens into a margin of said body.

2. The hanger claimed in claim 1, wherein said central portion and said flap segment define coactive means for retaining said flap segment against said central portion on folding of said flap segment about said fold line segment.

3. The hanger claimed in claim 1, wherein said fold line segment is contiguous with an interior end of said slot and provides cantilever support for said flap segment.

4. The garment hanger claimed in claim 2, wherein said coactive means is comprised of at least one projection on said flap segment and at least one latching opening in said central portion.

5. The garment hanger claimed in claim 2, wherein said coactive means is comprised of first and second projections on said flap segment adjacent respective lateral margins thereof and first and second latching openings in said central portion adjacent respective lateral margins thereof.

6. In combination:

(a) A garment hanger comprised of a one-piece body having a hook portion for the receipt of a display rod, a central portion depending from said hook portion, said body defining in said central portion an opening therethrough and a garment support member disposed in said opening and movable relative to said body and a lower portion defining a fold line segment depending from said central portion and a flap segment depending from said fold line segment, said central portion, said fold line segment and said flap segment jointly defining a slot in said body which extends through said fold line segment and opens into a margin of said body; and (b) a garment having a first part looped about said garment support member and a second part extending through said slot, said garment second part being disposed between said central portion and said flap segment.

7. The invention claimed in claim 6, wherein said central portion and said flap segment define coactive means for retaining said flap segment against said central portion on folding of said flap segment about said fold line segment.

8. The invention claimed in claim 6, wherein said fold line segment is contiguous with an interior end of said slot and provides cantilever support for said flap segment.

9. The invention claimed in claim 7, wherein said coactive means is comprised of at least one projection on said flap segment and at least one latching opening in said central portion.

10. The invention claimed in claim 7, wherein said coactive means is comprised of first and second projections on said flap segment adjacent respective lateral margins thereof and first and second latching openings in said central portion adjacent respective lateral margins thereof.

11. A garment hanger comprised of an upstanding one-piece body having a hook portion for the receipt of a display rod, a central portion depending vertically from said hook portion, said body defining in said central portion an opening therethrough and a garment support member disposed in said opening and movable relative to said body and a lower portion defining a fold line segment depending from a lower margin of said central portion and a flap segment depending from a lower margin of said fold line segment, said central portion, said fold line segment and said flap segment jointly defining a slot in said body which extends through said fold line segment and opens into a lowermost margin of said body.

* * * * *